United States Patent [19]

Paley

[11] 4,382,647

[45] May 10, 1983

[54] SWIVEL UNIT FOR ADJUSTABLE LIGHTING FIXTURE

[75] Inventor: Gary Paley, Cornwall-On-Hudson, N.Y.

[73] Assignee: Square D Company, Palatine, Ill.

[21] Appl. No.: 204,434

[22] Filed: Nov. 6, 1980

[51] Int. Cl.[3] ..... F21M 3/18

[52] U.S. Cl. ..... 339/7; 361/421

[58] Field of Search ..... 339/2 L, 2 A, 7; 362/421; 248/288.3

[56] References Cited

U.S. PATENT DOCUMENTS

| | | | |
|---|---|---|---|
| 1,411,048 | 3/1922 | McCosh | 362/421 X |
| 2,231,565 | 2/1941 | De Reamer et al. | 362/421 X |
| 2,859,983 | 11/1958 | May | 248/288.3 X |
| 3,072,426 | 1/1963 | Gilbert | 287/91 |
| 3,341,230 | 9/1967 | Wichers | 285/266 |
| 3,409,315 | 11/1968 | Wichers et al. | 285/175 |
| 4,333,132 | 6/1982 | Paley | 362/421 |

*Primary Examiner*—Eugene F. Desmond

*Attorney, Agent, or Firm*—John R. Garrett; Donald P. Reynolds; Richard T. Guttman

[57] ABSTRACT

This disclosure depicts a novel environmentally sealed and manually controlled swivel unit for use in an adjustable lighting fixture. The swivel unit comprises a base for establishing electrical and mechanical connection with a source of electrical power and is attached to a housing having a central housing bore. The swivel unit further comprises a swivel ball device having a spherical body and a tube extending from the spherical body with a means for sealing the swivel ball device within the housing. A lamp-holder is attached to the end of the tube. The swivel unit also comprises a minimum friction swivel ball controller and circular plate and a tension means for forcing the swivel ball controller against the swivel ball device, and, in turn, for forcing the swivel ball device against a shoulder of the housing. This defines a predetermined lamp-holding force. The swivel ball controller allows the swivel ball device to rotate about a first axis and also to rotate about a second axis perpendicular to the first axis. The swivel ball device and the shoulder on the housing form an environmentally sealed juncture.

8 Claims, 4 Drawing Figures

SWIVEL UNIT FOR ADJUSTABLE LIGHTING FIXTURE

CROSS REFERENCE TO RELATED APPLICATIONS

This application relates to, but is no way dependent upon, copending application of common ownership herewith, Ser. No. 37,623 filed Apr. 10, 1979, now U.S. Pat. No. 4,333,132, issued June 1, 1982.

BACKGROUND OF THE INVENTION AND PRIORITY STATEMENT

This invention relates in general to swivel units for lighting fixtures and, in particular, to a swivel unit which is environmentally sealed and easily adjusted without the use of any tools. Conventionally, swivel units have been utilized for lighting fixtures with the construction of the swivel unit being such that the lighting fixture is pivotable about one axis through substantially 90°, and pivotable about a second axis at right angles to the first axis through substantially 360°. This combination of pivotable movements enables the fixture to direct light over selected portions of an extensive area.

In order to keep the lighting fixture in its selected position, typical devices such as thumb screws, special clamps and normal screws have been used. Alternatively, springs under compression have also been used. However, in order to retain the lighting fixture in its selected position, devices using compressed springs must place these springs under a great deal of force. Devices utilizing a compressed spring are difficult to assemble and have a large number of parts. U.S. Pat. No. 3,072,426 issued to Gilbert and U.S. Pat. No. 3,409,315 issued to Wichers et al illustrate this type of device. Another patent illustrating this type of device is U.S. Pat. No. 3,341,230 issued to Wichers.

Another type of adjustable lighting fixture known utilizes a sphere clamped between two plates, thereby causing the sphere to be under tension and allowing the sphere to rotate between the plates. A drawback with this device and many others of similar construction is that the wiring in the device is not sealed to the outside atmosphere, and therefore, if this device is used outside, moisture or rain may contact the wiring and cause a short. The swivel unit disclosed in U.S. Pat. No. 3,072,426 appears to have no exposed wires; however, to achieve this it incorporates a large number of parts thereby having the drawback of expensive assembly.

The present invention has general applicability but is most advantageously applied to a swivel unit for a lighting fixture.

OBJECTS OF THE INVENTION

It is a general object of the present invention to provide for a lighting fixture an improved swivel unit.

It is a more specific object of the present invention to provide a swivel unit which remains at any selected position, while allowing easy manual movement of the swivel unit.

It is a further object to provide a swivel unit which is capable of rotating substantially 360° about a first axis and rotating substantially 90° about a second axis perpendicular to the first axis.

It is yet another object to provide a swivel unit which is environmentally sealed and has no exposed wiring.

It is still another object of the present invention to provide a swivel unit which is effective, yet low in cost, and provides an ease of assembly.

DESCRIPTION OF THE PREFERRED EMBODIMENT

Figures 1, 3:
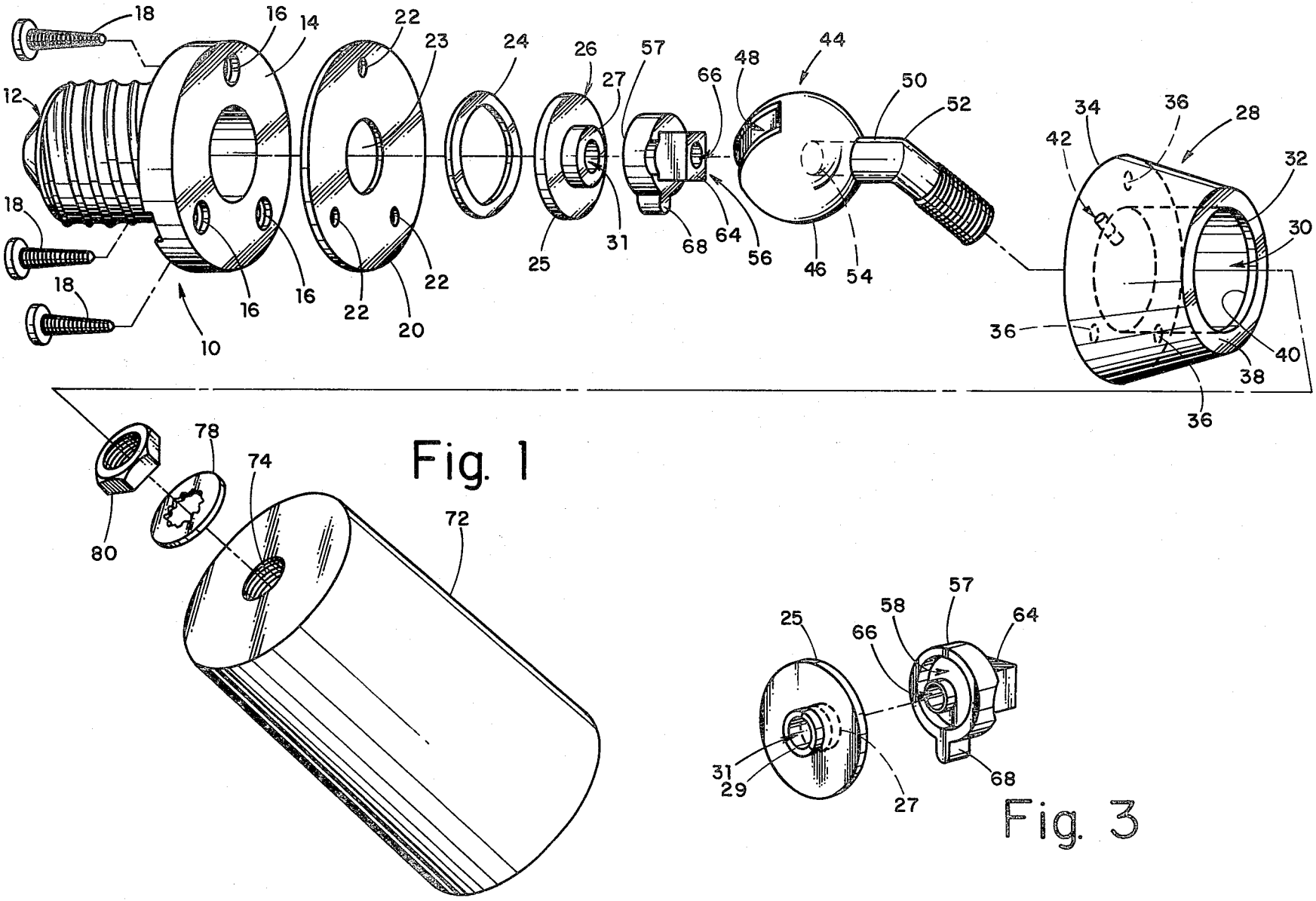
FIG. 1 is an exploded perspective view of the apparatus of the present invention.
FIG. 3 is a perspective view of three parts of the FIG. 1 swivel unit.

In general terms, this invention involves an improved novel environmentally sealed and manually controlled swivel unit. The swivel unit comprises in part a base for establishing electrical and mechanical connection with a source of electrical power. The swivel unit also has a positioning plate having an aperture with a predetermined diameter and a housing having a central housing bore defining an inner surface. The housing has a first end for attachment to the base and a second end. The housing also has a guide pin extending radially inwardly a predetermined distance from the inner surface and near the first end of the housing. The swivel unit further comprises a swivel ball device having a spherical body with a predetermined rectangular cavity completely disposed within the cavity and a tube extending from the spherical body radially opposite the cavity. The tube has a predetermined bend and the spherical body has a tunnel connecting the tube to the cavity. The spherical body also has a predetermined diameter substantially equal to the diameter of the central bore in the housing at the second end. The swivel ball is contained inside of the housing. The second end of the housing has a means for sealing the swivel ball within the housing. The swivel unit also comprises a minimum friction swivel ball controller which is completely disposed within the housing and has a circular body member. The controller also has a square cavity guide extension centrally located on a first side of the body member and a circular cavity located on a second side of the body member. The body member, the circular cavity, and the cavity guide extension have a central controller bore. The swivel ball controller also has a stop wall extending from the edge of the circular body member. The swivel ball controller is located in the central housing bore near the first end such that the cavity guide extension rides in the cavity in the swivel ball device, and the guide pin in the housing rides in the same plane as the stop wall. A circular minimum friction plate is located next to the swivel ball controller and has a circular disc with a diameter substantially equal to the diameter of the central housing bore at the first end and first and second circular extensions located on opposite sides of the disc. The first and second extensions and the disc have a central aperture. The first circular extension has a diameter substantially equal to the circular cavity in the swivel ball controller and the second circular extension has a diameter substantially equal to the aperture in the positioning plate. The swivel unit further comprises a tension means completely disposed within the housing for forcing the swivel ball controller against the swivel ball device, and, in turn, for forcing the swivel ball device against the sealing means of the housing. This defines a predetermined lamp-holding force. The tension means is located between the circular plate and the positioning plate when the base is attached to the first end of the housing. The swivel ball controller allows the swivel ball device to rotate about a first axis and also to rotate about a second axis perpendicular to the first axis. The swivel ball device and the sealing means form an environmentally sealed juncture. The predetermined lamp-holding force retains the swivel ball device at any selected position while allowing easy manual movement of the swivel ball device.

FIG. 1 shows an exploded perspective view of the present invention. In FIG. 1 a base 10 is used which can be screwed into a standard threaded socket. The base 10 has a threaded body 12 attached to a flange 14. The end of the threaded body 12 opposite the flange 14 is structured similarly to the standard lightbulb structure such that it will establish electrical connection with a standard socket. The flange 14 has holes 16 through which the threaded portion of screws 18 may pass. A metal positioning plate 20 with holes 22 and an aperture 23 is located next to the flange 14. A tension means, a wave washer 24, is sandwiched between the plate 20 and a circular minimum friction plate 26. Also, the plate 20 could be molded into the flange 14 of the base 10 if desired.

A housing 28 has a central housing bore 30 defining an inner surface 32. The housing 28 has a first end 34 with threaded holes 36 for attachment to the base 10. When assembled, the holes 16 in the flange 14 and the holes 22 in the retaining plate 20 are in alignment with the threaded holes 36 such that the screws 18 may pass through the holes 16 and 22 and be threaded into the holes 36, thereby securing the base 10 to the housing 28. The housing 28 also has a second end 38 which has an internal shoulder 40. A guide pin 42 extends radially inwardly a predetermined distance from the inner surface 32 near the first end 34 of the housing 28.

A swivel ball device 44 has a spherical body 46 with a predetermined rectangular cavity 48 and a tube 50 extending from the spherical body 46 opposite the cavity 48. The tube 50 has a bend 52 of approximately 45° and the spherical body 46 has a tunnel 54 connecting the tube 50 to the cavity 48. The spherical body 46 has a predetermined diameter substantially equal to the diameter of the central bore 30 in the second end in the housing 28. When assembled, the swivel ball device 44 is contained inside of the housing 28 adjacent the shoulder 40 on the second end 38 of the housing 28.

A swivel ball controller 56 completely disposed within the housing 28 has a circular body member 47. A square cavity guide extension 64 is centrally located on a first side of the body member 57 and a circular cavity 58 on a second side of the body member 57. The body member 62, the circular cavity 58 and the cavity guide extension 64 have a central controller bore 66. The swivel ball controller 56 also has a stop wall 68 extending from the edge of the circular body member 62. When assembled, the swivel ball controller 56 is located in the central housing bore 30 near the first end 34 of the housing 28, such that the cavity guide extension 64 rides in the cavity 48 in the swivel ball device 44 and the guide pin 42 in the housing 28 rides in the same plane as the stop wall 68. The stop wall prevents rotations of more than 360°, thereby preventing damage to wires inside the device.

A circular minimum friction plate 26 is located next to the swivel ball controller 56 and has a circular disc 25 with a diameter substantially equal to the diameter of the central housing bore 30 in the first end and also has first and second circular extension 27 and 29 located on opposite sides of the disc 25. The first and second circular extension 27 and 29 and the disc 25 have a central aperture 31. The first circular extension 27 has a diameter substantially equal to the circular cavity 30 in the second end of the swivel ball controller 28 and the second circular extension 29 has a diameter substantially equal to the aperture 23 in the positioning plate 20.

A standard lamp-holder 72 is secured to the end of the tube 50. In the preferred embodiment the end of the tube 50 is threaded so that a threaded hole in the lamp-holder 72 may be utilized to secure the lamp-holder 72 to the tube 50. A standard washer 78 and nut 80 lock the lamp-holder 72 onto the tube 50. Other methods could be utilized for attaching the lamp-holder 72.

Electrical wires (not shown) connect the base 10 to the lamp-holder 72 and are contained in the various apertures and tunnels in the components of the swivel unit as is well known in the art.

When assembled, the surface of the spherical body 46 of the swivel ball device 44 and the shoulder 40 of the housing 28 form a sealing means which is an environmentally sealed juncture thereby protecting the internal wiring of the swivel unit. Also in the assembled unit, the wave washer 24 is a tension means for forcing the swivel ball controller 56 against the swivel ball device 44 and, in turn, for forcing the swivel ball device 44 against the shoulder 40 of the housing 28, thereby defining a predetermined lamp-holding force. The predetermined lamp-holding force retains the swivel ball device 44 at any selected position while allowing easy manual movement.

The central controller bore 30, the cavity 48 and tunnel 54 in the spherical body 46 and the tube 50 of the swivel ball device 44 with the central controller bore 66, aperture 23 in the positioning plate 20 and the central aperture 31 of the circular plate 26 define a continuous passageway for electrical wires for electrically connecting electrical contacts on the base 10 to electrical contacts in the lamp-holder 72.

Figure 2A:
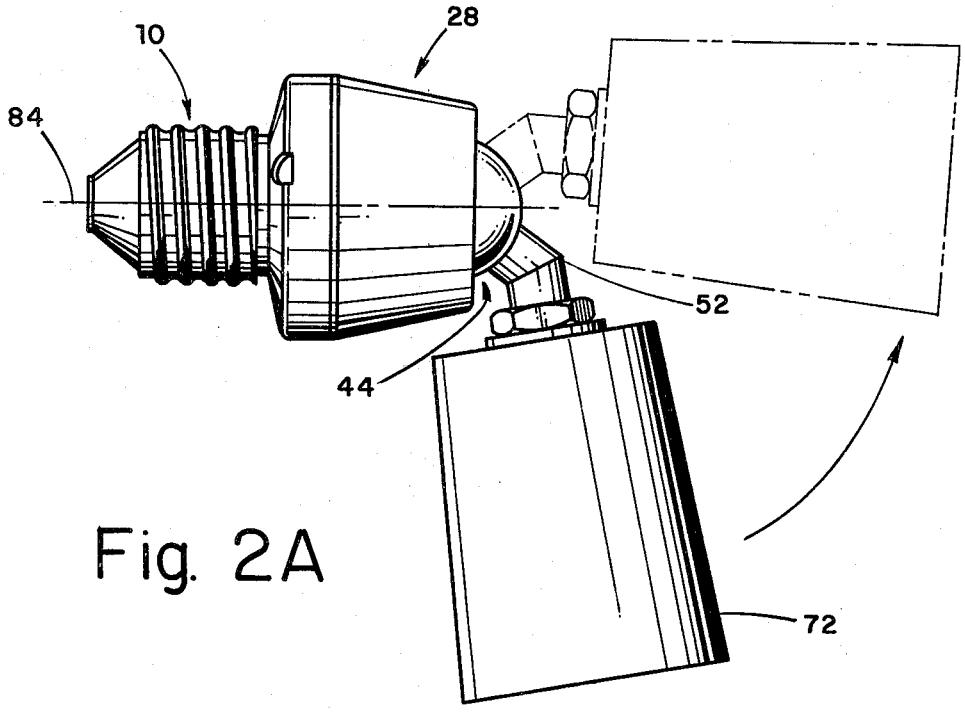
FIGS. 2A and 2B show an assembled lighting fixture and illustrate the movement of the swivel unit.
Figure 2B:
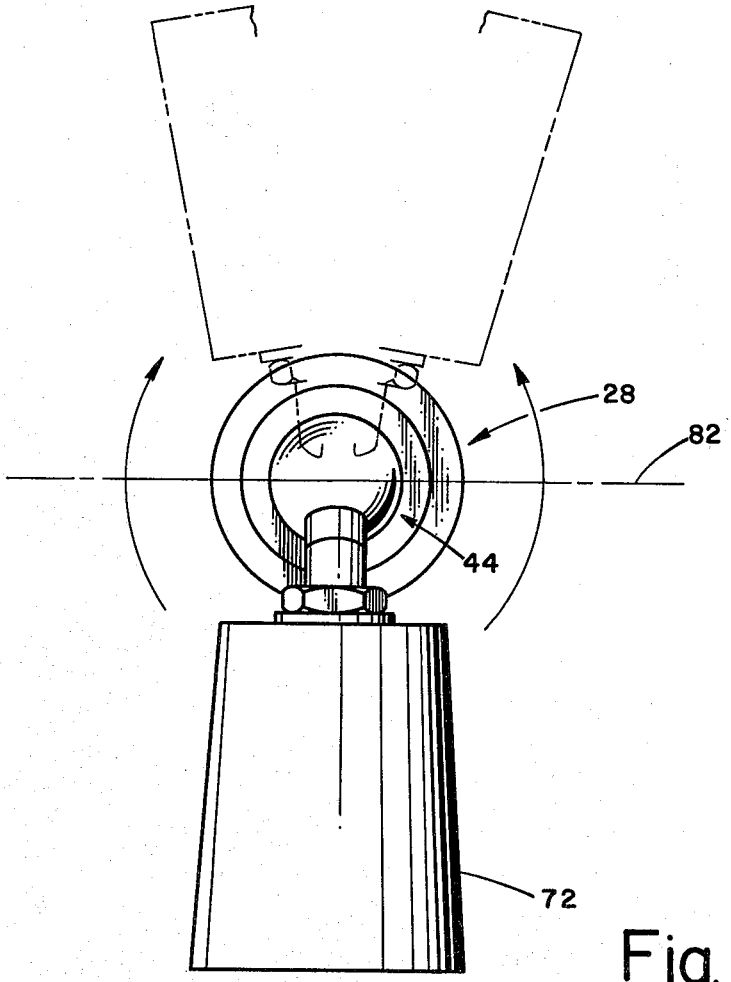

FIGS. 2A and 2B illustrate the range of rotation possible by the lamp-holder 72 and swivel ball device 44 while maintaining an environmentally sealed juncture of the swivel ball device 44 and the internal shoulder 40 of the housing 28. Because of the 45° bend 52 in the tube 50, the lamp-holder 72, in relation to the base 10 and housing 28, can achieve a rotation of 90° about a second axis 82. The first axis 84 is perpendicular to the second axis 82. The lamp-holder 72 and swivel ball device 44 can rotate about the first axis 84 a full 360°. Most importantly, any combination of a rotation within the 360° about the first axis 84 and within the 90° about the second axis 82 results in an environmentally sealed position such that the wiring is not exposed to moisture or any other weather condition.

The positioning plate, the housing and the swivel ball device may be made of any suitable metallic or non-metallic material. In the preferred embodiment the minimum friction swivel ball controller and circular plate are molded out of Nylon.

The invention is not limited to the particular details of construction of the device depicted and other modifications and applications are contemplated. Also, the base may have other configurations such as a plug-in-style for use with an electrical wall plug, a structure for direct attachment to an electrical outlet box, or structures for specialty applications. The invention may be used in a device having two or more swivel units and lamps.

Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. An improved environmentally sealed and manually controlled swivel unit comprising:

a base for establishing electrical and mechanical connection with a source of electrical power and having an aperture with a predetermined diameter;

a housing having a central housing bore defining an inner surface, said housing having a first end for attachment to said base and a second end, said housing also having a guide pin extending radially inward a predetermined distance from said inner surface near said first end;

means for attaching said base to said housing;

a swivel ball device having a spherical body with a predetermined rectangular cavity completely disposed within said housing and a tube extending radially from said spherical body and opposite to said cavity, said spherical body having a tunnel connecting said tube to said cavity, said spherical body also having a predetermined diameter substantially equal to the diameter of said central bore in said housing, said swivel ball being contained inside of said housing;

means for sealing said swivel ball device within said housing at said second end;

a minimum friction swivel ball controller completely disposed within said housing having a circular body member, said controller also having a square cavity guide extension centrally located on a first side of said body member, and a circular cavity located on a second side of said body member, said body member, said circular cavity and said cavity guide extension having a central controller bore, said swivel ball controller also having a stop wall extending from the edge of said circular body member, said swivel ball controller being located in said central housing bore near said first end such that said cavity guide extension rides in said cavity in said swivel ball device and said guide pin in said housing rides in the same plane as said stop wall;

a circular minimum friction plate having a circular disc with a diameter substantially equal to the diameter of said central housing bore and also having first and second circular extensions located on opposite sides of said disc, said first and second extension and said disc having a central aperture, said first circular extension having a diameter substantially equal to said circular cavity in said swivel ball controller and said second circular extension having a diameter substantially equal to said aperture in said base; and a tension means completely disposed within said housing for forcing said swivel ball controller against said swivel ball device and for forcing said swivel ball device against said sealing means of said housing thereby defining a predetermined lamp-holding force, said tension means being located between said circular plate and said base when said base is attached to said first end of said housing, wherein said swivel ball controller allows said swivel ball device to rotate about a first axis and to rotate about a second axis perpendicular to said first axis without exposing the cavity or wiring contained therein to the environment, and also wherein said swivel ball device and said sealing means form an environmentally sealed juncture regardless of the position or orientation of the lamp, and further wherein said predetermined lamp holding force retains said swivel ball device at any selected position while allowing easy manual movement of said swivel ball device.

2. The apparatus described in claim 1 wherein the sealing means comprises a shoulder on the second end of the housing and a surface of the spherical body.

3. An improved environmentally sealed and manually controlled swivel unit for use with a lamp-holder comprising:

a base for establishing electrical and mechanical connection with a source of electrical power;

a positioning plate having an aperture with a predetermined diameter, said plate being attached to said base;

a housing having a central housing bore defining an inner surface, said housing having a first end for attachment to said base and a second end, said housing also having a guide pin extending radially inward a predetermined distance from said inner surface near said first end;

means for attaching said base to said housing;

a swivel ball device having a spherical body with a predetermined rectangular cavity completely disposed within said housing and a tube extending from said spherical body radially and opposite to said cavity, said tube having a predetermined bend and said spherical body having a tunnel connecting said tube to said cavity, said spherical body also having a predetermined diameter substantially equal to the diameter of said central bore in said housing at said second end, said swivel ball being contained inside of said housing;

means for sealing said swivel ball device within said housing at said second end;

a minimum friction swivel ball controller completely disposed within said housing having a circular body member, said controller also having a square cavity guide extension centrally located on a first side of said body member, and a circular cavity located on a second side of said body member, said body member, said circular cavity and said cavity guide extension having a central controller bore, said swivel ball controller also having a stop wall extending from the edge of said circular body member, said swivel ball controller being located in said central housing bore near said first end such that said cavity guide extension rides in said cavity in said swivel ball device and said guide pin in said housing rides in the same plane as said stop wall;

a circular minimum friction plate having a circular disc with a diameter substantially equal to the diameter of said central housing bore at said first end and also having first and second circular extensions located on opposite sides of said disc, said first and second extension and said disc having a central aperture, said first circular extension having a diameter substantially equal to said circular cavity in said swivel ball controller and said second circular extension having a diameter substantially equal to said aperture in said positioning plate; and a tension means completely disposed within said housing for forcing said swivel ball controller against said swivel ball device and for forcing said swivel ball device against said sealing means of said housing thereby defining a predetermined lamp-holding force, said tension means being located between said circular plate and said positioning plate when said base is attached to said first end of said housing, wherein said swivel ball controller allows said swivel ball device to rotate about a first axis and to rotate about a second axis perpendicular to said first axis without exposing the cavity or wiring contained therein to the environment, and also wherein said swivel ball device and said sealing means form an environmentally sealed juncture regardless of the position or orientation of the lamp, and further wherein said predetermined lamp holding force retains said swivel ball device at any selected position while allowing easy manual movement of said swivel ball device.

4. The apparatus defined in claim 3, wherein said swivel ball device is able to rotate and orient the lamp substantially 360° about said first axis and substantially 90° about said second axis.

5. The apparatus described in claim 3, wherein the sealing means comprises a shoulder on the second end of the housing and a surface of the spherical body.

6. The apparatus described in claim 3, wherein the predetermined bend in said tube of said swivel ball device is approximately 45°.

7. The apparatus described in claim 3, wherein the lamp-holder is attached to the end of said tube opposite said spherical body of said swivel ball device.

8. The apparatus described in claim 7, wherein a means for providing electrical power from said base to the lamp-holder comprises electrical wires.

* * * * *